US007754406B2

(12) United States Patent
Vanbesien et al.

(10) Patent No.: US 7,754,406 B2
(45) **Date of Patent: *Jul. 13, 2010**

(54) ULTRA LOW MELT EMULSION AGGREGATION TONERS HAVING A CHARGE CONTROL AGENT

(75) Inventors: Daryl W. Vanbesien, Burlington (CA); Cuong Vong, Hamilton (CA); Paul J. Gerroir, Oakville (CA); Richard P. N. Veregin, Mississauga (CA); Karen A. Moffat, Brantford (CA); Peter J. G. Rehbein, Woodlawn (CA)

(73) Assignee: Xerox Corporation, Norwalk, CT (US)

( * ) Notice: Subject to any disclaimer, the term of this patent is extended or adjusted under 35 U.S.C. 154(b) by 774 days.

This patent is subject to a terminal disclaimer.

(21) Appl. No.: 11/672,723

(22) Filed: Feb. 8, 2007

(65) Prior Publication Data

US 2008/0193869 A1 Aug. 14, 2008

(51) Int. Cl.
*G03G 9/00* (2006.01)

(52) U.S. Cl. ..... 430/108.4; 430/124.1; 430/137.14

(58) Field of Classification Search ..... 430/108.4, 430/124.1, 137.14
See application file for complete search history.

(56) References Cited

U.S. PATENT DOCUMENTS

| | | | |
|---|---|---|---|
| 5,166,026 | A | 11/1992 | Fuller et al. |
| 5,714,292 | A | 2/1998 | Anno et al. |
| 6,413,691 | B2 | 7/2002 | Daimon et al. |
| 6,830,860 | B2 | 12/2004 | Sacripante et al. |
| 7,029,817 | B2 | 4/2006 | Robinson et al. |
| 2007/0184377 | A1 | 8/2007 | Shu et al. |

FOREIGN PATENT DOCUMENTS

| | | | |
|---|---|---|---|
| EP | 0 801 332 | A1 | 10/1997 |
| EP | 1 441 260 | A1 | 7/2004 |

OTHER PUBLICATIONS

European Search Report mailed Nov. 4, 2009.

*Primary Examiner*—Mark A Chapman
(74) *Attorney, Agent, or Firm*—Oliff & Berridge, PLC

(57) ABSTRACT

Toner compositions comprising toner particles including an amorphous resin, a crystalline resin and a charge control agent. The toner compositions having the charge control agent exhibit improved charge performance in the C-zone and the A-zone, and improved RH sensitivity.

23 Claims, No Drawings

ULTRA LOW MELT EMULSION AGGREGATION TONERS HAVING A CHARGE CONTROL AGENT

BACKGROUND

Disclosed herein are toner compositions comprising toner particles including an amorphous resin, a crystalline resin and a charge control agent. The toner compositions disclosed herein exhibit improved charge performance in the C-zone and the A-zone, and improved RH sensitivity.

REFERENCES

Low fixing toners comprised of semicrystalline resins are known, such as those disclosed in U.S. Pat. No. 5,166,026. There, toners comprised of a semicrystalline copolymer resin, such as poly(alpha-olefin) copolymer resins, with a melting point of from about 30° C. to about 100° C., and containing functional groups comprising hydroxy, carboxy, amino, amido, ammonium or halo, and pigment particles, are disclosed.

Low fixing crystalline based toners are disclosed in U.S. Pat. No. 6,413,691. There, a toner comprised of a binder resin and a colorant, the binder resin containing a crystalline polyester containing a carboxylic acid of two or more valences having a sulfonic acid group as a monomer component, are illustrated.

Ultra low melt toner compositions comprising a branched amorphous resin, a crystalline resin and a colorant are disclosed in U.S. Pat. No. 6,830,860, which is incorporated herein by reference in its entirety.

One issue with current crystalline and semi-crystalline toners and development systems comprising such toners is that they do not perform well in all humidities. It is desirable that developers be functional under all environmental conditions to enable good image quality from a printer. In other words, it is desirable for developers to function and exhibit good charging performance, at low humidity such as a 15% relative humidity at a temperature of about 10° C. (denoted herein as C-zone) and at high humidity such as at 85% relative humidity at a temperature of about 28° C. (denoted herein as A-zone).

Toner blends containing crystalline or semi-crystalline polyester resins with an amorphous resin have been recently shown to provide very desirable ultra-low melt fusing, which is a key enabler for high-speed printing and for lower fuser power consumption. These types of toners containing crystalline polyester have been demonstrated for both emulsion aggregation (EA) toners, and in conventional jetted toners. However, charging performance, particularly in A-zone, has been a significant issue.

Thus, toners comprising crystalline materials that exhibit good charging in both A-zone and C-zone are still desired.

SUMMARY

In embodiments, disclosed herein is a toner composition comprising toner particles having a crystalline resin, an amorphous resin and a charge control agent.

In further embodiments, disclosed herein is a method comprising forming an emulsion comprising at least a crystalline resin and a charge control agent, forming another emulsion comprising at least an amorphous resin, combining the emulsion of crystalline resin and charge control agent and the emulsion of amorphous resin to form a pre-toner mixture, and aggregating the pre-toner mixture to form toner particles.

In yet further embodiments, disclosed herein is a method of developing an image, comprising applying a toner composition to a substrate to form an image, the toner composition comprising an amorphous resin, a crystalline resin and a charge control agent, and fusing the toner composition to the substrate.

EMBODIMENTS

Disclosed herein is a toner comprising toner particles having an amorphous resin, a crystalline resin and a charge control agent.

Examples of amorphous resins suitable for use herein include both branched and linear amorphous resins, and combinations of branched and linear amorphous resins. Specific examples of amorphous resins suitable for use herein include polyester resins, branched polyester resins, polyimide resins, branched polyimide resins, poly(styrene-acrylate) resins, poly(styrene-methacrylate) resins, crosslinked poly(styrene-methacrylate) resins, poly(styrene-butadiene) resins, crosslinked poly(styrene-butadiene) resins, alkali sulfonated-polyester resins, branched alkali sulfonated-polyester resins, alkali sulfonated-polyester resins, branched alkali sulfonated-polyimide resins, alkali sulfonated poly(styrene-acrylate) resins, crosslinked alkali sulfonated poly(styrene-acrylate) resins, poly(styrene-methacrylate) resins, crosslinked alkali sulfonated-poly(styrene-methacrylate) resins, alkali sulfonated-poly(styrene-butadiene) resins, and crosslinked alkali sulfonated poly(styrene-butadiene) resin, polyester, a polyamide, a polyester-imide, an alkali sulfonated polyamide, an alkali sulfonated polyimide, an alkali sulfonated polystyrene-acrylate, an alkali sulfonated polyester-imide, copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfoisophthalate), copoly(propylene-butylene-terephthalate)-copoly(propylene-butylene-5-sulfo-isophthalate), copoly(propoxylated bisphenol-A-fumarate)-copoly(propoxylated bisphenol-A-5-sulfo-isophthalate), copoly(ethoxylated bisphenol-A-fumarate)-copoly(ethoxylated bisphenol-A-5-sulfo-isophthalate), copoly(ethoxylated bisphenol-A-maleate)copoly(ethoxylated bisphenol-A-5-sulfo-isophthalate), poly(ethylene-terephthalate), poly(propylene-terephthalate), poly(diethylene-terephthalate), poly (propylene-diethylene-terephthalate), poly(propylene-butylene-terephthalate), poly(propoxylated bisphenol-A-fumarate), or poly(ethoxylated bisphenol-A-fumarate), or poly(ethoxylated bisphenol-A-maleate).

The amorphous resin may include crosslinked portions therein, for example such that the toner has a weight fraction of the microgel (a gel content) in the range of, for example, from about 0.001 to about 50 weight percent, such as from about 0.1 to about 40 weight percent or from about 1 to about 10 weight percent, of the amorphous polyester. The gel content may be achieved either by mixing in an amount of crosslinked material, or crosslinking portions of the amorphous polyester, for example by including a crosslinking initiator in the amorphous polyester. The initiators may be, for example, peroxides such as organic peroxides or azo-compounds, for example diacyl peroxides such as decanoyl peroxide, lauroyl peroxide and benzoyl peroxide, ketone peroxides such as cyclohexanone peroxide and methyl ethyl ketone, alkyl peroxy esters such as t-butyl peroxy neodecanoate, 2,5-dimethyl 2,5-di(2-ethyl hexanoyl peroxy)hexane, t-amyl peroxy 2-ethyl hexanoate, t-butyl peroxy 2-ethyl hexanoate, t-butyl peroxy acetate, t-amyl peroxy acetate, t-butyl peroxy benzoate, t-amyl peroxy benzoate, oo-t-butyl o-isopropyl mono peroxy carbonate, 2,5-dimethyl 2,5-di (benzoyl peroxy)hexane, oo-t-butyl o-(2-ethyl hexyl)mono peroxy carbonate, and oo-t-amyl o-(2-ethyl hexyl)mono peroxy carbonate, alkyl peroxides such as dicumyl peroxide, 2,5-dimethyl 2,5-di(t-butyl peroxy)hexane, t-butyl cumyl peroxide, bis(t-butyl peroxy)diisopropyl benzene, di-t-butyl peroxide and 2,5-dimethyl 2,5-di(t-butyl peroxy)hexyne-3, alkyl hydroperoxides such as 2,5-dihydro peroxy 2,5-dimethyl hexane, cumene hydroperoxide, t-butyl hydroperoxide and t-amyl hydroperoxide, and alkyl peroxyketals such as n-butyl 4,4-di(t-butyl peroxy)valerate, 1,1-di(t-butyl peroxy) 3,3,5-trimethyl cyclohexane, 1,1-di(t-butyl peroxy)cyclohexane, 1,1-di(t-amyl peroxy)cyclohexane, 2,2-di(t-butyl peroxy)butane, ethyl 3,3-di(t-butyl peroxy)butyrate and ethyl 3,3-di(t-amyl peroxy)butylate, azobis-isobutyronitrile, 2,2'-azobis(isobutyronitrile), 2,2'-azobis(2,4-dimethyl valeronitrile), 2,2'-azobis(methyl butyronitrile), 1,1'-azobis(cyano cyclohexane), 1,1'-di(t-butyl peroxy)-3,3,5-trimethylcyclohexane, combinations thereof and the like. The amount of initiator used is proportional to the degree of crossing, and thus the gel content of the polyester material. The amount of initiator used may range from, for example, about 0.01 to about 10 weight percent, such as from about 0.1 to about 5 weight percent or the amorphous polyester. In the crosslinking, it is desirable that substantially all of the initiator be used up. The crosslinking may be carried out at high temperature, and thus the reaction may be very fast, for example, less than 10 minutes, such as from about 20 seconds to about 2 minutes residence time.

The branched amorphous polyester resins are generally prepared by the polycondensation of an organic diol, a diacid or a diester, a multivalent polyacid or polyol as the branching agent, a polycondensation catalyst and optionally a sulfonated difunctional monomer. The sulfonated difunctional monomer may optionally be an alkali sulfonated difunctional monomer.

Examples of diacid or diesters selected for the preparation of amorphous polyesters and crystalline polyester include dicarboxylic acids or diesters such as terephthalic acid, phthalic acid, isophthalic acid, fumaric acid, maleic acid, itaconic acid, succinic acid, succinic anhydride, dodecylsuccinic acid, dodecylsuccinic anhydride, glutaric acid, glutaric anhydride, adipic acid, pimelic acid, suberic acid, azelic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and mixtures thereof. Further examples of organic diacids or diesters suitable for use herein include oxalic acid, sebacic acid, naphthalene-2,6-dicarboxylic acid, naphthalene-2,7-dicarboxylic acid, cyclohexane dicarboxylic acid, malonic acid and mesaconic acid, a diester or anhydride thereof, and an alkali sulfo-organic diacid such as the sodio, lithio or potassio salt of dimethyl-5-sulfo-isophthalate, dialkyl-5-sulfo-isophthalate-4-sulfo-1,8-naphthalic anhydride, 4-sulfo-phthalic; acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexaniediol, 3-sulfo-2-methylpentanediol, 2-sulfo-3,3-dimethylpentanediol, sulfo-1-hydroxybenzoic acid, N,N-bis(2-hydroxyethyl)-2-amino ethane sulfonate, or mixtures thereof. The organic diacid or diester are selected, for example, from about 25 to about 75 mole percent of the resin, such as from about 40 to about 60 or from about 45 to about 52 mole percent of the resin.

Examples of diols utilized in generating the amorphous polyester and the crystalline polyester may include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hyroxyethyl)-bisphenol A, bis(2-hyroxypropyl)-bisphenol A, 1,4-cyclohexanedimethanol, 1,3-cyclohexanedimethanol, xylenedimethanol, cyclohexanediol, diethylene glycol, bis(2-hydroxyethyl)oxide, dipropylene glycol, dibutylene, and mixtures thereof. Examples of organic diols may further include aliphatic diols with from about 2 to about 36 carbon atoms, such as 1,2-ethanediol, 1,8-octanediol, 1,9-nonanediol, 1,10-decanediol, 1,12-dodecanediol and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The amount of organic diol selected can vary, and may be from about 25 to about 75 mole percent of the resin, such as from about 40 to about 60 or from about 45 to about 52 mole percent of the resin.

Alkali sulfonated difunctional monomer examples, wherein the alkali is lithium, sodium, potassium, or the like, include dimethyl-5-sulfo-isophthalate, dialkyl-5-sulfo-isophthalate-4-sulfo-1,8-naphthalic anhydride, 4-sulfo-phthalic acid, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, dialkyl-sulfo-terephthalate, sulfo-ethanediol, 2-sulfo-propanediol, 2-sulfo-butanediol, 3-sulfo-pentanediol, 2-sulfo-hexanediol, 3-sulfo-2-methylpentanediol, N,N-bis(2-hydroxyethyl)-2-aminoethane sulfonate, 2-sulfo-3,3-dimethylpentadiol, sulfo-p-hydroxybenzoic acid, mixtures thereof, and the like. Effective difunctional monomer amounts of, for example, from about 0.01 to about 10 weight percent of the resin, such as from about 0.05 to about 5 weight percent or from about 0.1 to about 2 weight percent of the resin can be selected.

Branching agents to generate a branched amorphous polyester resin include, for example, a multivalent polyacid such as 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl)methane, and 1,2,7,8-octanetetracarboxylic acid, acid anhydrides thereof, and lower alkyl esters thereof, 1 to about 6 carbon atoms; a multivalent polyol such as sorbitol, 1,2,3,6-hexanetetrol, 1,4-sorbitane, pentaerythritol, dipentaerythritol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, 1,3,5-trihydroxymethylbenzene, mixtures thereof, and the like. The branching agent amount selected is, for example, from about 0.01 to about 10 mole percent of the resin, such as from about 0.05 to about 8 mole percent or from about 0.1 to about 5 mole percent of the resin.

The amorphous resin is, for example, present in an amount from about 50 to about 90 percent by weight, such as from about 65 to about 85 percent by weight, of the binder. In embodiments, the amorphous resin possesses, for example, a number average molecular weight (Mn), as measured by gel permeation chromatography (GPC), of from about 2,000 to about 50,000, such as from about 3,000 to about 25,000; a weight average molecular weight (Mw) of, for example, from about 5,000 to about 100,000, such as from about 6,000 to about 90,000, as determined by GPC using polystyrene standards; and wherein the molecular weight distribution (Mw/Mn) is, for example, from about 1.5 to about 13, such as from about 2 to about 12.

The crystalline resin may be, for example, a polyester, a polyamide, a polyimide, a polyethylene, a polypropylene, a polybutylene, a polyisobutyrate, an ethylene-propylene copolymer, or an ethylene-vinyl acetate copolymer or a polyolefin.

Examples of crystalline resins that are suitable for use herein include poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly ethylene-sebacate), poly(propylene-sebacate), poly(butylene-sebacate), poly(pentylene-sebacate), poly(hexylene-sebacate), poly(octylene-sebacate), copoly(5-sulfoisophthaloyl)-copoly(ethylene-adipate), copoly(5-sulfoisophthaloyl)-copoly(propylene-adipate), copoly(5-sulfoisophthaloyl)-copoly(butylene-adipate), copoly(5-sulfo-isophthaloyl)-copoly(pentylene-adipate), copoly(5-sulfo-isophthaloyl)-copoly(hexylene-adipate), copoly(5-sulfo-isophthaloyl)-copoly(octylene-adipate), copoly(5-sulfo-isophthaloyl)-copoly(ethylene-adipate), copoly(5-sulfo-isophthaloyl)-copoly(propylene-adipate), copoly(5-sulfo-isophthaloyl)-copoly(butylene-adipate), copoly(5-sulfo-isophthaloyl)-copoly pentylene-adipate), copoly(5-sulfo-isophthaloyl)-copoly(hexylene-adipate), copoly(5-sulfo-isophthaloyl)-copoly(octylene-adipate), copoly(5-sulfoisophthaloyl)-copoly(ethylene-succinate), copoly(5-sulfoisophthaloyl)-copoly(propylene-succinate), copoly 5-sulfoisophthaloyl)-copoly(butylene-succinate), copoly 5-sulfoisophthaloyl)-copoly(pentylene-succinate), copoly (5-sulfoisophthaloyl)-copoly(hexylene-succinate), copoly (5-sulfoisophthaloyl)-copoly(octylene-succinate), copoly(5-sulfo-isophthaloyl)-copoly(ethylene-sebacate), copoly(5-sulfo-isophthaloyl)-copoly(propylene-sebacate), copoly(5-sulfo-isophthaloyl)-copoly(butylenes-sebacate), copoly(5-sulfo-isophthaloyl)-copoly(pentylene-sebacate), copoly(5-sulfo-isophthaloyl)-copoly(hexylene-sebacate), copoly(5-sulfo-isophthaloyl)-copoly(octylene-sebacate), copoly(5-sulfo-isophthaloyl)-copoly(ethylene-adipate), copoly(5-sulfo-isophthaloyl)-copoly(propylene-adiapte), copoly(5-sulfo-isophthaloyl)-copoly(butylene-adipate), copoly(5-sulfo-isophthaloyl)-copoly(pentylene-adipate), copoly(5-sulfo-isophthaloyl)-copoly(hexylene-adipate), poly (octylene-adipate), copoly(ethylene-dodecane dioate-fumarate) or combinations thereof.

The crystalline resin in the toner may display or possess a melting temperature of, for example, from about 60° C. to about 85° C., and a recrystallization temperature of at least about 43° C., such as a recrystallization temperature of, for example, from about 45° C. to about 80° C. The crystalline resin may be sulfonated from about 0.1 weight percent to about 4.5 weight percent, such as from about 0.5 weight percent to about 3.0 weight percent.

As used herein, "crystalline" refers to a polymer with a three dimensional order. "Semicrystalline resins" as used herein refer to resins with a crystalline percentage of, for example, from about 10 to about 60 percent, and more specifically from about 12 to about 50 percent. Further, as used hereinafter "crystalline" encompass both crystalline resins and semicrystalline materials, unless otherwise specified.

If semicrystalline polyester resins are employed herein, the semicrystalline resin includes, for example, poly(3-methyl-1-butene), poly(hexamethylene carbonate), poly(ethylene-p-carboxy phenoxy-butyrate), poly(ethylene-vinyl acetate), poly(docosyl acrylate), poly(dodecyl acrylate), poly(octadecyl acrylate), poly(octadecyl methacrylate), poly(behenylpolyethoxyethyl methacrylate), poly(ethylene adipate), poly(decamethylene adipate), poly(decamethylene azelaate), poly(hexamethylene oxalate), poly(decamethylene oxalate), poly(ethylene oxide), poly(propylene oxide), poly(butadiene oxide), poly(decamethylene oxide), poly(decamethylene sulfide), poly(decamethylene disulfide), poly(ethylene sebacate), poly(decamethylene sebacate), poly(ethylene suberate), poly(decamethylene succinate), poly(eicosamethylene malonate), poly(ethylene-p-carboxy phenoxy-undecanoate), poly(ethylene dithionesophthalate), poly(methyl ethylene terephthalate), poly(ethylene-p-carboxy phenoxy-valerate), poly(hexamethylene-4,4'-oxydibenzoate), poly(10-hydroxy capric acid), poly(isophthalaldehyde), poly(octamethylene dodecanedioate), poly(dimethyl siloxane), poly(dipropyl siloxane), poly(tetramethylene phenylene diacetate), poly (tetramethylene trithiodicarboxylate), poly(trimethylene dodecane dioate), poly(m-xylene), poly(p-xylylene pimelamide), and combination thereof. The semicrystalline resins possess, for example, a suitable weight average molecular weight Mw of from about 7,000 to about 200,000, such as from about 10,000 to about 150,000, and a number average molecular weight Mn of, for example, from about 1,000 to about 60,000, such as from about 3,000 to about 50,000.

In embodiments, the crystalline resin is derived from monomers selected from 5-sulfoisophthalic acid, sebacic acid, dodecanedioic acid, ethylene glycol and butylene glycol. One skilled in the art will easily recognize that the monomer can be any suitable monomer to generate the crystalline resin. For example, sebacic acid may be replaced by fumaric acid or adipic acid.

The crystalline resin is, for example, present in an amount of from about 3 to about 50 percent by weight of the binder, such as from about 5 to about 40 percent by weight of the binder.

The crystalline resin may possess a number average molecular weight (Mn), as measured by gel permeation chromatography (GPC) of, for example, from about 1,000 to about 50,000, such as from about 2,000 to about 25,000; with a weight average molecular weight (Mw) of the resin of, for example, from about 2,000 to about 100,000, such as from about 3,000 to about 80,000, as determined by GPC using polystyrene standards. The molecular weight distribution (Mw/Mn) of the crystalline resin is, for example, from about 2 to about 6, such as from about 2 to about 4.

The crystalline resin may be prepared by a polycondensation process of reacting an organic diol and an organic diacid in the presence of a polycondensation catalyst. Suitable organic diols and organic diacids for preparing crystalline resins may be the same as those suitable for preparing amorphous resins and are described above. Generally, a stochiometric equimolar ratio of organic diol and organic diacid is utilized. However, in some instances, wherein the boiling point of the organic diol is from about 180° C. to about 230° C., an excess amount of diol may be utilized and removed during the polycondensation process.

The amount of catalyst utilized varies, and may be selected in an amount, for example, of from about 0.01 to about 1 mole percent of the resin. Additionally, in place of an organic diacid, an organic diester may also be selected, and where an alcohol byproduct is generated.

Polycondensation catalyst examples for either the crystalline or amorphous polyesters include tetraalkyl titanates, dialkyltin oxide such as dibutyltin oxide, tetraalkyltin such as dibutyltin dilaurate, dialkyltin oxide hydroxide such as butyltin oxide hydroxide, aluminum alkoxides, alkyl zinc, dialkyl zinc, zinc oxide, stannous oxide, or mixtures thereof, and which catalysts are selected in amounts of, for example, from about 0.01 mole percent to about 5 mole percent based on the starting diacid or diester used to generate the polyester resin.

Ultra low melt emulsion/aggregation toners comprising crystalline polyester resin and amorphous polyester resin having good fusing properties and good vinyl offset are known. Such toners may exhibit lower A-zone and C-zone charge distribution, for example, because the crystalline polyester resin may tend to migrate to the surface of the toner particles during coalescence at a temperature around the melting point of the crystalline polyester resin. While the presence of the crystalline resin acts to lower the melting point of the toner, its presence on the surface of the toner may adversely affect the charging performance of the toner.

To address any issues with A-zone and C-zone charge distribution of the toner particles described herein, a charge control agent is incorporated directly into the crystalline polyester resin during the emulsion or dispersion process. Thus, during toner preparation, if any crystalline polyester resin comes to the surface of the toner particles, such crystalline resin will contain the charge control agent, which will offset any effects of the crystalline resin migrating to the particle surface with respect to the A-zone and C-zone charge distribution of the toner particles.

In embodiments, the crystalline resin and the charge control agent may be located at an outer portion of the toner particles. That is, the crystalline resin and the charge control agent may be located on the toner surface, but inside any external additives that may be present on the toner particles. Although the crystalline resin and the charge control agent may migrate towards the surface of the toner particles, a portion of the crystalline resin and charge control agent present in the toner particles may remain within the core of the toner particles.

In embodiments, the charge control agent is an internal charge control agent, such as an acryl based polymeric charge control agent. In further embodiments, the charge control agent is a styrene-acrylate polymer, such as:

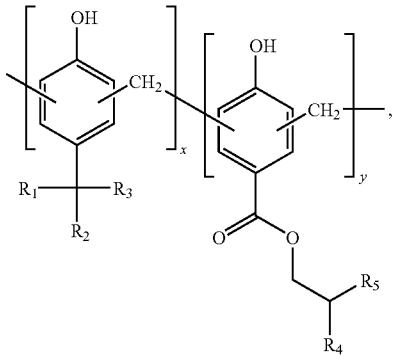

where $R_1$, $R_2$ and $R_3$ may be hydrogen, or an alkyl group such as methyl or ethyl, $R_4$ and $R_5$ may be an alkyl group such as methyl, ethyl, propyl or butyl, x may be from about 0.4 to about 0.8, such as from about 0.5 to about 0.7 or about 0.6, and y may be from about 0.2 to about 0.6, such as from about 0.3 to about 0.5 or about 0.4.

In embodiments, the charge control agent is present in the toner particles in amounts of from about 0.5 weight percent to about 20 weight percent, such as from about 1.0 weight percent to about 15 weight percent or from about 1.5 weight percent to about 10 weight percent, of the weight of the toner particles.

The charge control agent effectively raises the A-zone and C-zone charge distribution of a parent toner particle, which is the toner before being blended with any external additives, thus effectively raising the A-zone and C-zone charge distribution of the final toner particles. In embodiments, the desired charge distribution for the parent toner particle in both the A-zone and the C-zone is from about −0.1 to about −12 mm displacement, such as from about −0.2 to about −11 mm displacement.

The charge performance or distribution of a toner is frequently demarcated as q/d (mm). The toner charge (q/d) is measured as the midpoint of the toner charge distribution. The charge is reported in millimeters of displacement from the zero line in a charge spectrograph using an applied transverse electric field of 100 volts per cm. The q/d measure in mm displacement can be converted to a value in fC/μm by multiplying the value in mm by 0.092.

In embodiments, it is desired that the ratio of the charge distribution in the A-zone to the C-zone be as close to 1 as possible. This charge ratio (C-zone/A-zone) is frequently referred to as the relative humidity (RH) sensitivity by those skilled in the art. In embodiments, the RH sensitivity may be in a range of less than about 10, such as from about 0.5 to about 4.

In embodiments, the charge control agent may be incorporated into the crystalline resin by any known or later developed method. An example of a method for generating a resin emulsion having a crystalline resin and charge control agent is disclosed in U.S. Pat. No. 7,029,817, which is incorporated herein in its entirety by reference.

In further embodiments, the crystalline resin and charge control agent may be prepared by dissolving resin and charge control agent in a suitable solvent. Any resin emulsion may be similarly prepared. Suitable solvents include alcohols, ketones, esters, ethers, chlorinated solvents, nitrogen containing solvents and mixtures thereof. Specific examples of suitable solvents include acetone, methyl acetate, ethyl acetate, methyl ethyl ketone, tetrahydrofuran, cyclohexanone, ethyl acetate, N,N dimethylformamide, dioctyl phthalate, toluene, xylene, benzene, dimethylsulfoxide, mixtures thereof and the like. If desired or necessary, the crystalline resin and charge control agent can be dissolved in the solvent at elevated temperature, such as about 40° C. to about 80° C. or about 50° C. to about 70° C. or about 60° C. to about 65° C., although the temperature is desirably lower than the glass transition temperature of the wax and resin. In embodiments, the resin and charge control agent are dissolved in the solvent at elevated temperature, but below the boiling point of the solvent, such as at about 2° C. to about 1.5° C. or about 5° C. to about 10° C. below the boiling point of the solvent.

The resin and charge control agent are dissolved in the solvent, and are mixed into an emulsion medium, for example water such as deionized water containing a stabilizer, and optionally a surfactant. Examples of suitable stabilizers include water-soluble alkali metal hydroxides, such as sodium hydroxide, potassium hydroxide, lithium hydroxide, beryllium hydroxide, magnesium hydroxide, calcium hydroxide, or barium hydroxide; ammonium hydroxide;

alkali metal carbonates, such as sodium bicarbonate, lithium bicarbonate, potassium bicarbonate, lithium carbonate, potassium carbonate, sodium carbonate, beryllium carbonate, magnesium carbonate, calcium carbonate, barium carbonate or cesium carbonate; or mixtures thereof. In embodiments, a particularly desirable stabilizer is sodium bicarbonate or ammonium hydroxide. When the stabilizer is used in the composition, it is typically present in amounts of from about 0.1 percent to about 5 percent, such as from about 0.5 percent to about 3 percent, by weight of the wax and resin. When such salts are added to the composition as a stabilizer, it is desired in embodiments that incompatible metal salts are not present in the composition. For example, when these salts are used, the composition should be completely or essentially free of zinc and other incompatible metal ions, for example, Ca, Fe, Ba, etc. that form water-insoluble salts. The term "essentially free" refers, for example, to the incompatible metal ions as present at a level of less than about 0.01 percent, such as less than about 0.005 percent or less than about 0.001 percent, by weight of the wax and resin. If desired or necessary, the stabilizer can be added to the mixture at ambient temperature, about 25° C., or it can be heated to the mixture temperature prior to addition.

Optionally, it nay be desirable to add an additional stabilizer such as a surfactant to the aqueous emulsion medium such as to afford additional stabilization to the resin. Suitable surfactants include anionic, cationic and nonionic surfactants. In embodiments, the use of anionic and nonionic surfactants can additionally help stabilize the aggregation process in the presence of the coagulant, which otherwise could lead to aggregation instability.

Anionic surfactants include sodium dodecylsulfate (SDS), sodium dodecyl benzene sulfonate, sodium dodecylnaphthalene sulfate, dialkyl benzenealkyl, sulfates and sulfonates, abitic acid, and the NEOGEN brand of anionic surfactants. An example of a suitable anionic surfactant is NEOGEN R-K available from Daiichi Kogyo Seiyaku Co. Ltd. (Japan), or TAYCAPOWER BN2060 from Tayca Corporation (Japan), which consists primarily of branched sodium dodecyl benzene sulfonate.

Examples of cationic surfactants include dialkyl benzene alkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecyl benzyl triethyl ammonium chloride, MIRAPOL and ALKAQUAT available from Alkaril Chemical Company, SANISOL (benzalkonium chloride), available from Kao Chemicals, and the like. An example of a suitable cationic surfactant is SANISOL, B-50 available from Kao Corporation, which consists primarily of benzyl dimethyl alkonium chloride.

Examples of nonionic surfactants include polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc Inc. as IGEPAL CA-210, IGEPAL CA-520, IGEPAL, CA-720, IGEPAL, CO-890, IGEPAL CO-7230, IGEPAL CO-290, IGEPAL CA-210, ANTAROX 890 and ANTAROX 897. An example of a suitable nonionic surfactant is ANTAROX 897 available from Rhone-Poulenc Inc., which consists primarily of alkyl phenol ethoxylate.

After the stabilizer or stabilizers are added, the resultant mixture can be mixed or homogenized for any desired time.

Next, the mixture may be heated to flash off the solvent, and then cooled to room temperature. For example, the solvent flashing can be conducted at any suitable temperature above the boiling point of the solvent in water that will flash off the solvent, such as about 60° C. to about 100° C., such as about 70° C. to about 90° C. or about 80° C., although the temperature may be adjusted based on, for example, the particular wax, resin, and solvent used.

Following the solvent flash step, the crystalline resin and charge control agent emulsion, in embodiments, has an average particle diameter in the range of about 100 to about 500 nanometers, such as from about 130 to about 300 nanometers as measured with a Honeywell MICROTRAC® UPA150 particle size analyzer.

A pre-toner mixture is prepared by combining the colorant, and optionally a wax or other materials, surfactant, and both the crystalline resin/charge control agent emulsion and amorphous resin emulsion. In embodiments, the pH of the pre-toner mixture is adjusted to from about 2.5 to about 4. The pH of the pre-toner mixture may be adjusted by an acid such as, for example, acetic acid, nitric acid, and the like. Additionally, in embodiments, the pre-toner mixture optionally may be homogenized. If the pre-toner mixture is homogenized, homogenization may be accomplished by mixing at about 600 to about 4,000 revolutions per minute. Homogenization may be accomplished by any suitable means, including, for example, an IKA ULTRA TURRAX T50 probe homogenizer.

Following the preparation of the pre-toner mixture, an aggregate mixture is formed by adding an aggregating agent (coagulant) to the pre-toner mixture. The aggregating agent is generally an aqueous solution of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the pre-toner mixture at a temperature that is below the glass transition temperature ($T_g$) of the emulsion resin. In some embodiments, the aggregating agent may be added in an amount of about 0.05 to about 3 pph and from about 1 to about 10 pph with respect to the weight of toner. The aggregating agent may be added to the pre-toner mixture over a period of from about 0 to about 60 minutes. Aggregation may be accomplished with or without maintaining homogenization. Aggregation is accomplished at temperatures that may be greater then 60° C.

In embodiments, although either a multivalent salt, such as polyaluminum chloride, or a divalent salt, such as zinc acetate, may be used, and the toner formulations may be identical for both aggregating agents, the process of preparing the toner particles is different. A divalent cation material may be used in embodiments in which the binder includes both linear amorphous and crystalline polyesters. In the case of the multivalent salt, anion and nonionic surfactants may be added to the latex mixture to stabilize the particle and reduce the shocking when a multivalent aggregating agent like PAC is added. PAC may be added at room temperature (cold addition) to initiate aggregation in the presence of the pigment, since the addition of PAC at elevated temperature may not be effective. In embodiments in which divalent salts are used as aggregating agents, the agent may be added at elevated temperature, for example about 50 to 60° C. (hot addition) as opposed to cold addition. The primary reason for this is that zinc acetate dissociates itself into the aqueous phase and the particle (pKa of zinc acetate is about 4.6). The dissociation is temperature dependent as well as pH dependent. When zinc acetate is added at elevated temperature, the temperature factor is minimized or eliminated. The amount of zinc acetate added can control the particle size, while in the case of cold addition of zinc acetate, neither of these parameters can be controlled.

Thus, the process calls for blending the crystalline polyester resin and the linear and/or branched amorphous polyester resin emulsions, together in the presence of a pigment and optionally a wax or other additives, all comprising submicron particles, heating the blend from room temperature to about 60° C., followed by addition of zinc acetate solution. The temperature may be slowly raised to 65° C. and held there for from about 3 hours to about 9 hours, such as about 6 hours, in order to provide from about 6 micron to about 12 micron particles, such as about 9 micron particles, that the have a circularity of, for example, about 0.930 to about 0.980 as measured on the FPIA SYSMEX analyzer.

When a multivalent ion like PAC is used as the aggregating agent, it may be added cold as discussed above. Thus, the process steps are different than with zinc acetate, and calls for the addition of surfactants to the latex blend, followed by the addition of the pigment and optional additives. The surfactant stabilizes the particles by either electrostatic or steric forces or both, to prevent massive flocculation, when the aggregating agent is added. The pH of the blend containing the toner resin, pigment, optional additives (wax), etc. is adjusted from about 5.6 to about 3.0 with 0.1 M nitric acid, followed by the addition of PAC, while being polytroned at speeds of about 5000 rpm. The temperature of the mixture is raised from room temperature to 55° C., and slowly in stages to about 70° C. in order to coalesce the particles. No pH adjustment is required to stabilize the particle size in either of the two aggregating agent processes.

Following aggregation, the aggregates may be coalesced. Coalescence may be accomplished by heating the aggregate mixture to a temperature that is about 5° C. to about 20° C. above the $T_g$ of the amorphous resin. Generally, the aggregated mixture is heated to a temperature of about 50° C. to about 80° C. In embodiments, the mixture may also be stirred at from about 200 to about 750 revolutions per minute to coalesce the particles. Coalescence may be accomplished over a period of from about 3 to about 9 hours.

Optionally, during coalescence, the particle size of the toner particles may be controlled and adjusted to a desired size by adjusting the pH of the mixture. Generally, to control the particle size, the pH of the mixture is adjusted to between about 5 to about 7 using a base such as, for example, sodium hydroxide.

After coalescence, the mixture may be cooled to room temperature. After cooling, the mixture of toner particles of some embodiments may be washed with water and then dried. Drying may be accomplished by any suitable method for drying including freeze drying. Freeze drying is typically accomplished at temperatures of about −80° C. for a period of about 72 hours.

Upon aggregation and coalescence, the toner particles of embodiments have an average particle size of from about 1 to about 15 microns, in further embodiments of from about 3 to about 15 microns, and, in particular embodiments, of from about 3 to about 11 microns, such as about 7 microns. The geometric size distribution (GSD) of the toner particles of embodiments may be it, a range of from about 1.20 to about 1.35, and in particular embodiments of less than about 1.25.

In embodiments, the process may include the use of surfactants, emulsifiers, and other additives such as those discussed above. Likewise, various modifications of the above process will be apparent and are encompassed herein.

The toner particles described herein may further include other components, such as colorants, waxes and various external additives. Colorant includes pigment, dye, mixtures of dyes, mixtures of pigments, mixtures of dyes and pigments, and the like.

When present, the colorant may be added in an effective amount of, for example, from about 1 to about 25 percent by weight of the particle, such as in an amount of from about 2 to about 15 weight percent. Suitable example colorants include, for example, carbon black like REGAL 330® magnetites, such as Mobay magnetites MO8029™, M08060™; Columbian magnetites; MAPICO BLACKS™ and surface treated magnetites; Pfizer magnetites CB4799™, CBS5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there may be selected cyan, magenta, yellow, red; green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B201 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubinic Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), and Lithol Fast Scarlet L4300 (BASF).

Optionally, a wax may be present in an amount of from about 4 to about 30 percent by weight of the particles. Examples of waxes, if present, include polypropylenes and polyethylenes commercially available from Allied Chemical and Petrolite Corporation, Fischer-Tropsch waxes commercially available from Nippon Seiro, wax emulsions available from Michaelman Inc. and the Daniels Products Company, EPOLENE N-15™ commercially available from Eastman Chemical Products, Inc., VISCOL 550-P™, a low weight average molecular weight polypropylene available from Sanyo Kasei K.K., and similar materials. The commercially available polyethylenes selected usually possess a number average molecular weight of from about 1,000 to about 1,500, while the commercially available polypropylenes utilized for the toner compositions of the present invention are believed to have a number average molecular weight of from about 4,000 to about 5,000. Examples of functionalized waxes include amines, amides, imides, esters, quaternary amines, carboxylic acids or acrylic polymer emulsion, for example JONCRYL™ 74, 89, 130, 537, and 538, all available from SC Johnson Wax, chlorinated polypropylenes and polyethylenes commercially available from Allied Chemical and Petrolite Corporation and SC Johnson wax.

The resulting particles can possess an average volume particle diameter of about 2 to about 25 microns, such as from about 3 to about 15 microns or from about 5 to about 7 microns.

Any suitable surface additives may be selected. Examples of additives are surface treated fumed silicas, for example TS-530 from Cabosil Corporation, with an 8 nanometer particle size and a surface treatment of hexamethyldisilazane; NAX50 silica, obtained from DeGussa/Nippon Aerosil Corporation, coated with HMDS; DTMS silica, obtained from Cabot Corporation, comprised of a fumed silica silicon dioxide core L90 coated with DTMS; H2050EP, obtained from Wacker Chemie, coated with an amino functionalized organopolysiloxane; metal oxides such as $TiO_2$, for example MT-3103 from Tayca Corp. with a 16 nanometer particle size and a surface treatment of decylsilane; SMT5103, obtained from Tayca Corporation, comprised of a crystalline titanium dioxide core MT500B coated with DTMS; P-25 from Degussa Chemicals with no surface treatment; alternate metal oxides such as aluminum oxide, and as a lubricating agent, for example, stearates or long chain alcohols, such as UNILIN 700™, and the like. In general, silica is applied to the toner surface for toner flow, tribo enhancement, admix control, improved development and transfer stability, and higher toner blocking temperature. $TiO_2$ is applied for improved relative humidity (RH) stability, tribo control and improved development and transfer stability.

The $SiO_2$ and $TiO_2$ may more specifically possess a primary particle size greater than approximately 30 nanometers, or at least 40 nanometers, with the primary particles size measured by, for instance, transmission electron microscopy (TEM) or calculated (assuming spherical particles) from a measurement of the gas absorption, or BET, surface area. $TiO_2$ is found to be especially helpful in maintaining development and transfer over a broad range of area coverage and job run length. The $SiO_2$ and $TiO_2$ are more specifically applied to the toner surface with the total coverage of the toner ranging from, for example, about 140 to about 200 percent theoretical surface area coverage (SAC), where the theoretical SAC (hereafter referred to as SAC) is calculated assuming all toner particles are spherical and have a diameter equal to the volume median diameter of the toner as measured in the standard Coulter Counter method, and that the additive particles are distributed as primary particles on the toner surface in a hexagonal closed packed structure. Another metric relating to the amount and size of the additives is the sum of the "SAC×Size" (surface area coverage times the primary particle size of the additive in nanometers) for each of the silica and titania particles, or the like, for which all of the additives should, more specifically, have a total SAC×Size range of, for example, about 4,500 to about 7,200. The ratio of the silica to titania particles is generally from about 50 percent silica/50 percent titania to about 85 percent silica/15 percent titania (on a weight percentage basis).

Examples of suitable $SiO_2$ and $TiO_2$ are those surface treated with compounds including DTMS (decyltrimethoxysilane) or HMDS (hexamethyldisilazane). Examples of these additives are NAX50 silica, obtained from DeGussa/Nippon Aerosil Corporation, coated with HMDS; DTMS silica, obtained from Cabot Corporation, comprised of a fumed silica, for example silicon dioxide core L90 coated with DTMS; H2050EP, obtained from Wacker Chemie, coated with an amino functionalized organopolysiloxane; and SMT5103, obtained from Tayca Corporation, comprised of a crystalline titanium dioxide core MT500B, coated with DTMS.

Calcium stearate and zinc stearate can be selected as an additive for the toners of the present invention in embodiments thereof, the calcium and zinc stearate primarily providing lubricating properties. Also, the calcium and zinc stearate can provide developer conductivity and tribo enhancement, both due to its lubricating nature. In addition, calcium and zinc stearate enables higher toner charge and charge stability by increasing the number of contacts between toner and carrier particles. A suitable example is a commercially available calcium and zinc stearate with greater than about 85 percent purity, for example from about 85 to about 100 percent pure, for the 85 percent (less than 12 percent calcium oxide and free fatty acid by weight, and less than 3 percent moisture content by weight) and which has an average particle diameter of about 7 microns and is available from Ferro Corporation (Cleveland, Ohio). Examples are SYNPRO® Calcium Stearate 392A and SYNPRO®Calcium Stearate NF Vegetable or Zinc Stearate-L. Another example is a commercially available calcium stearate with greater than 95 percent purity (less than 0.5 percent calcium oxide and free fatty acid by weight, and less than 4.5 percent moisture content by weight), and which stearate has an average particle diameter of about 2 microns and is available from NOF Corporation (Tokyo, Japan). In embodiments, the toners contain from, for example, about 0.1 to about 5 weight percent titania, about 0.1 to about 8 weight percent silica, and from about 0.1 to about 4 weight percent calcium or zinc stearate.

When external additives are present on the toner particles, the charge distribution of such particles in the A-zone may be from about −1 to about −5 nun displacement, such as from about −1 to about −4 nun displacement, and the charge distribution of such toner particles in the C-zone may be from about −2 to about −11 mm displacement, such as from about −3 to about −10 mm displacement.

The toner particles of all embodiments may be included in developer compositions. In embodiments, developer compositions comprise toner particles, such as those described above, mixed with carrier particles to form a two-component developer composition. In some embodiments, the toner concentration in the developer composition may range from about 1 weight percent to about 25 weight percent, such as from about 2 weight percent to about 15 weight percent, of the total weight of the developer composition.

Examples of carrier particles suitable for mixing with the toner include those particles that are capable of triboelectrically obtaining a charge of opposite polarity to that of the toner particles, such as granular zircon, granular silicon, glass, steel, nickel, ferrites, iron ferrites, silicon dioxide, and the like.

The selected carrier particles can be used with or without a coating, the coating generally being comprised of fluoropolymers, such as polyvinylidene fluoride resins; terpolymers of styrene; methyl methacrylate; silanes, such as triethoxy silane; tetrafluoroethylenes; other known coatings; and the like.

In applications in which the described toners are used with an image-developing device employing roll fusing, the carrier core may be at least partially coated with a polymethyl methacrylate (PMMA) polymer having a weight-average molecular weight of 300,000 to 350,000, e.g., such as commercially available from Soken. PMMA is an electropositive polymer that will generally impart a negative charge on the toner by contact. The coating has, in embodiments, a coating weight of from about 0.1 weight percent to about 5.0 weight percent, or from about 0.5 weight percent to about 2.0 weight percent of the carrier. PMMA may optionally be copolymerized with any desired comonomer, such that the resulting copolymer retains a suitable particle size. Suitable comonomers can include monoalkyl, or dialkyl amines, such as dimethylaminoethyl methacrylates, diethylaminoethyl methacrylates, diisopropylaminoethyl methacrylates, tert-butylaminoethyl methacrylates, and the like, and mixtures thereof. The carrier particles may be prepared by mixing the carrier core with from about 0.05 weight percent to about 10 weight percent of polymer, such as from about 0.05 weight percent to about 3 weight percent of polymer, based on the weight of the coated carrier particles, until the polymer coating adheres to the carrier core by mechanical impaction and/or electrostatic attraction. Various effective suitable means can be used to apply the polymer to the surface of the carrier core particles, for example, cascade-roll mixing, tumbling, milling, shaking, electrostatic powder-cloud spraying, fluidized bed, electrostatic disc processing, and with an electrostatic curtain. The mixture of carrier core particles and polymer may then be heated to melt and fuse the polymer to the carrier core particles. The coated carrier particles are then cooled and classified to a desired particle size.

Carrier particles can be mixed with toner particles in any suitable combination in embodiments. In some embodiments, for example, about 1 to about 10 parts by weight of toner particles are mixed with from about 10 to about 300 parts by weight of the carrier particles.

In embodiments, any known type of image development system may be used in an image developing device, including, for example, magnetic brush development, jumping single-component development, hybrid scavengeless development (HSD), etc. These development systems are well known in the art, and further explanation of the operation of these devices to form an image is thus not necessary herein. Once the image is formed with toners/developers of the invention via a suitable image development method such as any one of the aforementioned methods, the image is then transferred to an image receiving medium such as paper and the like. In an embodiment of the present invention, it is desired that the toners be used in developing an image in an image-developing device utilizing a fuser roll member. Fuser roll members are contact fusing devices that are well known in the art, in which heat and pressure from the roll are used in order to fuse the toner to the image-receiving medium. Typically, the fuser member may be heated to a temperature just above the fusing temperature of the toner, that is, to temperatures of from about 80° C. to about 150° C. or more.

Embodiments described above will now be further illustrated by way of the following examples.

EXAMPLES

Several toners having black pigments were prepared to illustrate the present disclosure as demonstrated in Table 1. Without limiting the present disclosure, it is believed that since the crystalline resin flows to the surface of the toner, the charge control agent in the crystalline resin improves charging because the charge control agent will flow to the surface of the toner along with the crystalline resin.

TABLE 1

Composition of Toner Examples

| | Comparative Toner Example | Toner 1 | Toner 2 | Toner 3 | Toner 4 |
|---|---|---|---|---|---|
| Amorphous Resin | 54% | 51% | 80% | 83% | 54% |
| Crystalline Resin | 29% | 29% | None | None | 26% |
| Charge Control Agent | None | 3% in Amorphous Resin | 3% in Amorphous Resin | None | 3% in Crystalline Resin |
| Colorant | 8% | 9% | 8% | 8% | 8% |
| Wax | 9% | 9% | 9% | 9% | 9% |

TABLE 1-continued

| Composition of Toner Examples | | | | | |
|---|---|---|---|---|---|
| | Comparative Toner Example | Toner 1 | Toner 2 | Toner 3 | Toner 4 |
| A-zone charge | −0.2 mm | −0.03 mm | −3.1 mm | −1.6 mm | −0.2 mm |
| C-zone charge | −1.5 mm | −1.1 mm | −5.5 mm | −2.9 mm | −2.7 mm |

Resin Emulsion Example 1

100 grams of amorphous resin poly(propoxylated bisphenol-A-fumarate) was weighed out into a 2 L flask, then was dissolved into about 1200 g of ethyl acetate, and heated to about 65° C.

In a separate 4 L flask, about 1100 grams de-ionized water and about 2.5 grams of surfactant was added. This solution was heated to about 60° C. When this temperature was achieved, the solution was homogenized at about 8800 RPM and the amorphous resin/ethyl acetate solution was poured into the 4 L flask over a period of about 2 minutes.

The resulting creamy mixture was homogenized for about an additional 30 minutes. The flask was then heated to about 80° C. for about 2 hours to remove the ethyl acetate, and the solution was allowed to stir overnight.

Resin Emulsion Example 2

Resin Example 1 was repeated, but about 100 grams of crystalline resin made from ethylene diol, dodecanediacid, and fumaric acid was used instead of the amorphous resin.

Resin Emulsion Example 3

Example 1 was repeated, except that about 92.6 grams of amorphous resin was used in addition to about 7.4 grams of charge control agent having the formula:

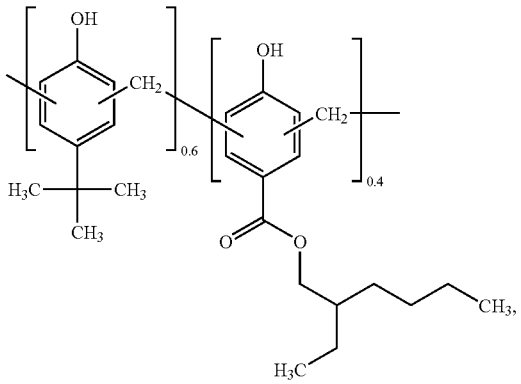

Resin Emulsion Example 4

Example 2 was repeated, except that about 89.7 grams of crystalline resin was used in addition to about 10.3 grams of charge control agent.

Comparative Toner Example

To a 2 L flask was added about 130 grams of Resin Emulsion Example 1 (about 12.45 percent solids), about 77.5 grams Resin Emulsion Example 2 (about 11.24 percent solids), about 15.1 grams of colorant (about 17.05 percent black pigment), about 12.66 grams of wax emulsion (about 21.85 percent solids) and about 36 grams de-ionized water.

The pH of the mixture was then adjusted to about 3.3 using about 0.3M $HNO_3$. About 15.53 grams $Al_2(SO_4)_3$ (about 1.0 weight percent diluted in about 0.02M $HNO_3$) was added in as flocculent under homogenization. The mixture was subsequently heated to about 35° C., and then slowly heated to about 43° C. for aggregation at about 600 RPM.

The particle size was monitored with a coulter counter until the volume average particle size was about 5.8 with a GSD of about 1.25. The pH was then increased to about 8 using NaOH to halt the toner growth. Thereafter, the reaction mixture was headed to 83° C. for coalescence and held for about 30 minutes. The toner slurry was then cooled to about room temperature, such as about 25° C., separated by sieving (about 25 μm), filtration, followed by washing and freeze drying.

The resulting toner contained about 54 percent amorphous resin, about 29 percent crystalline resin, about 8 percent wax, and about 9 percent colorant.

Toner Example 1

The process for making Toner Example 1 is the same as the process for making the Comparative Toner Example, except that instead of Resin Emulsion Example 1, about 163.4 grams of Resin Emulsion Example 3 (about 10.15 percent solids) was used. The resulting toner contained about 51 percent amorphous resin, about 29 percent crystalline resin, about 8 percent wax, about 9 percent colorant, and about 3 percent charge control agent.

Toner Example 2

The process for making Toner Example 2 is the same as the process for making the Comparative Toner Example, except that no crystalline resin was present in the toner. The resulting toner contained about 80 percent amorphous resin, about 8 percent wax, about 9 percent colorant, and about 3 percent charge control agent.

Toner Example 3

The process for making Toner Example 3 is the same as the process for making Toner Example 1, except that instead there was no crystalline resin used in the toner. The resulting toner contained about 83 percent amorphous resin, 8 percent carnuba wax, and 9 percent black pigment.

Toner Example 4

The process for making Toner Example 4 is the same as the process for making Toner Example 1, except that instead of Resin Example 2, about 91.6 grams of Resin Example 4 (about 9.51 percent solids) was used. The resulting toner contained about 54 percent amorphous resin, about 26 percent crystalline resin, about 8 percent carnuba wax, and 9 percent black pigment, and about 3 percent charge control agent.

Results

As seen from Table 1 above, the charge displacement in A-zone and C-zone was improved when the charge control agent was included in the toner particle formulation. Two samples of about 8 grams of toner and about 100 grams of carrier were weighed into a 60 mL bottle and conditioned overnight in A-zone (about 15% RH and about 10° C.) and in C-zone (about 85% RH and about 28° C.). These developers were then mixed for about 60 minutes on a paint shaker. Charge was measured on a charge spectrograph, measuring the q/d in mm displacement in an electric field of 100 V/mm. The charge displacement in mm corresponds to a charge of 0.092 femtocoulombs/micron for each mm displacement.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A toner composition comprising toner particles having a crystalline resin, an amorphous resin and a charge control agent, wherein the charge control agent is incorporated into the crystalline resin prior to formation of the toner particles, wherein at least a portion of the crystalline resin and the incorporated charge control agent is located on an outer portion of the toner particles separate from the amorphous resin in a core portion of the toner particles, and wherein the toner particles have an A-zone charge distribution and a C-zone charge distribution of from about −0.1 mm displacement to about −12 mm displacement.

2. The toner composition according to claim 1, wherein the A-zone charge distribution and the C-zone charge distribution is from about −0.2 mm to about −11 mm displacement.

3. The toner composition according to claim 1, wherein the charge control agent has a formula:

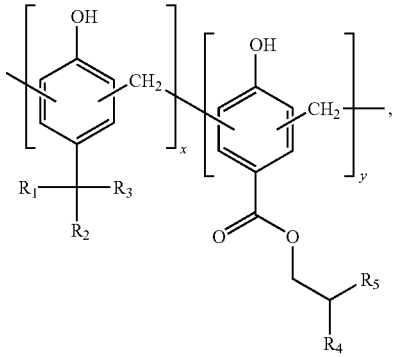

wherein $R_1$, $R_2$ and $R_3$ are each independently hydrogen or an alkyl, $R_4$ and $R_5$ are each independently an alkyl, x is a number from about 0.4 to about 0.8, and y is a number from about 0.2 to about 0.6.

4. The toner composition according to claim 3, wherein the alkyl for $R_1$, $R_2$ and $R_3$ is methyl or ethyl, and the alkyl for $R_4$ and $R_5$ is methyl, ethyl, propyl or butyl.

5. The toner composition according to claim 1, wherein the toner particles are emulsion aggregation toner particles.

6. The toner composition according to claim 1, wherein the crystalline resin is selected from the group consisting of a polyester, a polyamide, a polyimide, a polyethylene, a polypropylene, a polybutylene, a polyisobutyrate, an ethylene-propylene copolymer, and an ethylene-vinyl acetate copolymer.

7. The toner composition according to claim 1, wherein the amorphous resin is a branched amorphous resin, a linear amorphous resin or a mixture thereof.

8. The toner composition according to claim 7, wherein the branched amorphous resin is selected from the group consisting of a polyester, a polyamide, a polyimide, a polystyrene-acrylate, a polystyrene-methacrylate, a polystyrene-butadiene, a polyester-imide, an alkali sulfonated polyester, an alkali sulfonated polyamide, an alkali sulfonated polyimide, an alkali sulfonated polystyrene-acrylate, an alkali sulfonated polystyrene-methacrylate, an alkali sulfonated polystyrene-butadiene, or an alkali sulfonated polyester-imide.

9. The toner composition according to claim 1, wherein the charge control agent is present in the toner particles in amounts of from about 0.5 weight percent to about 20 weight percent.

10. The toner composition according to claim 1, wherein the toner particles have a RH sensitivity range of less than about 10.

11. The toner composition according to claim 1, wherein the toner particles further include a colorant and/or a wax.

12. A method of developing an image, comprising:

applying the toner composition of claim 1 to a substrate to form an image, and fusing the toner composition to the substrate.

13. A method, comprising incorporating a charge control agent into a crystalline resin by forming an emulsion comprising the crystalline resin and the charge control agent having a formula of:

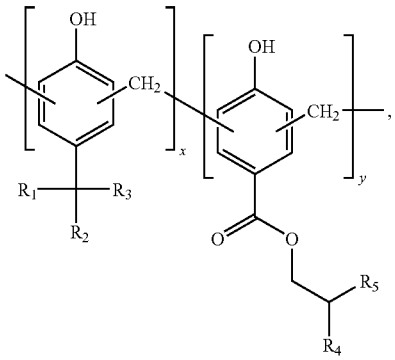

forming an emulsion comprising an amorphous resin, combining the emulsion of the crystalline resin and the charge control agent and the emulsion of the amorphous resin to form a pre-toner mixture, and aggregating and coalescing the pre-toner mixture to form toner particles, wherein $R_1$, $R_2$ and $R_3$ are each independently hydrogen or an alkyl, $R_4$ and $R_5$ are each independently an alkyl, x is a number from about 0.4 to about 0.8, and y is a number from about 0.2 to about 0.6 and wherein at least a portion of the crystalline resin and the incorporated charge control agent is located on an outer portion of the toner particles separate from the amorphous resin in a core portion of the toner particles.

14. The method according to claim 13, wherein the alkyl for $R_1$, $R_2$ and $R_3$ is methyl or ethyl, and the alkyl for $R_4$ and $R_5$ is methyl, ethyl, propyl or -butyl butyl.

15. The method according to claim 13, wherein the incorporating the charge control agent into the crystalline resin by forming the emulsion having the crystalline resin and the charge control agent comprises:

dissolving the crystalline resin and the charge control agent in a solvent to form a solution, mixing the solution into an emulsion medium to form a mixture, and heating the mixture to flash off the solvent to form the emulsion having the crystalline resin and the incorporated charge control agent.

16. The method according to claim 15, wherein the solvent is selected from the group consisting of acetone, methyl acetate, ethyl acetate, methyl ethyl ketone, tetrahydrofuran, cyclohexanone, ethyl acetate, N,N dimethylformamide, dioctyl phthalate, toluene, xylene, benzene, dimethylsulfoxide, and mixtures thereof.

17. The method according to claim 15, wherein the emulsion medium comprises water and a stabilizer.

18. The method according to claim 13, wherein the crystalline resin is selected from the group consisting of a polyester, a polyamide, a polyimide, a polyethylene, a polypropylene, a polybutylene, a polyisobutyrate, an ethylene-propylene copolymer, and an ethylene-vinyl acetate copolymer.

19. The method according to claim 13, wherein the amorphous resin is a branched amorphous resin or a linear amorphous resin.

20. The method according to claim 19, wherein the branched amorphous resin is selected from the group consisting of a polyester, a polyamide, a polyimide, a polystyrene-acrylate, a polystyrene-methacrylate, a polystyrene-butadiene, a polyester-imide, an alkali sulfonated polyester, an alkali sulfonated polyamide, an alkali sulfonated polyimide, an alkali sulfonated polystyrene-acrylate, an alkali sulfonated polystyrene-methacrylate, an alkali sulfonated polystyrene-butadiene, and an alkali sulfonated polyester-imide.

21. The method according to claim 13, wherein the toner particles have an A-zone charge distribution and a C-zone charge distribution of from about −0.1 mm displacement to about −12 mm displacement.

22. The method according to claim 21, wherein the A-zone charge distribution and the C-zone charge distribution is from about −0.2 mm to about −11 mm displacement.

23. The method according to claim 13, wherein the pre-toner mixture further comprises a colorant and/or a wax.

* * * * *